United States Patent [19]

Dubin

[11] Patent Number: 5,037,483

[45] Date of Patent: Aug. 6, 1991

[54] ON-LINE IRON CLEAN-UP

[75] Inventor: Leonard Dubin, Skokie, Ill.

[73] Assignee: Nalco Chemical Company, Naperville, Ill.

[21] Appl. No.: 472,525

[22] Filed: Jan. 30, 1990

[51] Int. Cl.[5] ..... B08B 3/08

[52] U.S. Cl. ..... 134/3; 134/28; 252/83

[58] Field of Search ..... 134/3, 28

[56] References Cited

U.S. PATENT DOCUMENTS 4,190,463 2/1980 Kaplan ..... 134/28

4,481,040 11/1984 Brookes et al. ..... 134/3

4,610,728 9/1986 Natesh et al. ..... 134/3

*Primary Examiner*—Asok Pal

*Attorney, Agent, or Firm*—Robert A. Miller; Donald G. Epple

[57] ABSTRACT

An iron oxide cleaning composition and method for using these compositions as disclosed. This cleaning process uses formaldehyde sulfoxylate reducing agents in combination with hydrolyzable tanning extracts and chelating agents to remove deposited iron oxide from metal surfaces, particularly those surfaces exposed to recirculating cooling waters.

18 Claims, No Drawings

ON-LINE IRON CLEAN-UP

INTRODUCTION

Most industrial heat exchangers are composed of bundles of ferrous metal tubes through which cooling waters are pumped on the cooling side and processed liquids or vapors are passed on the process side for the purpose of cooling these process vapors and/or liquids. Most of these constructions are metallic and of an iron or steel nature, although non-ferrous metals such as admiralty metals are also used. These heat exchange systems involve heat transfer to the circulating cooling waters where the heat is removed atmospherically by passing these waters through cooling towers.

These industrial cooling systems can rapidly form iron oxide deposits on the heat transfer surface, particularly when this heat transfer surface is made of iron or iron alloys such as steels. Even if the heat transfer surface itself is not iron or an iron alloy, if the system itself is exposed to iron or an iron alloy, these same iron oxide deposits can form on the heat transfer surface in general. The formation of these deposits reduced the heat transfer efficiency, and therefore, techniques which remove these iron oxide deposits are valuable for energy conservation.

It is common to mechanically clean these heat transfer surfaces when the iron oxide deposits become excessive, however mechanical cleaning, while effective in many cases, is time consuming, expensive, and requires shut down of the unit being cleaned.

Prior useful technology has existed for chemically cleaning these heat transfer surfaces of deposited iron oxides while the system is still "on line". By "on line", we mean that the system is performing its function of heat transfer from process gasses or liquids into recirculating cooling waters by means of heat transfer to those cooling waters which themselves are cooled through circulation through cooling towers. This cleaning can also occur when the system is off line merely by circulating waters which contain the treating agents through the system while it is off line, and providing sufficient time and temperature to accomplish the removal of these iron oxides from the surfaces being treated.

In the art, the techniques taught by Kaplan, U.S. Pat. No. 4,190,463, involve the treatment of these iron oxide deposits found on heat transfer surfaces by first contacting these deposits with an aqueous solution of a hydrolyzable tanning extract followed subsequently by the removal of the conditioned deposits with treatment by dilute solutions of citric acid. The teachings and disclosures in U.S. Pat. No. 4,190,463 are incorporated herein by reference.

Any improvements over this teaching would be an advance in the art. Therefore, it is an object of this invention to disclose and claim improved methods for removing iron oxide deposits, which methods provide for better and quicker removal of these oxide deposits from heat transfer surfaces on which they are accumulated.

It is another object of this invention to describe methods and techniques for removing these iron oxide deposits from those heat transfer surfaces in contact with recirculating water in an industrial cooling system where the water is obtained from a cooling water basin underneath a cooling tower. It is also an object of this invention to disclose the use of a reducing agent in combination with hydrolyzable tanning extracts which may be used together or sequentially to condition the iron oxide surfaces prior to their being contacted by chelating agents, thereby removing the iron oxide deposits so treated.

THE INVENTION

We have discovered an improved method for removing iron oxide deposits from heat transfer surfaces which comprises sequentially treating said surfaces as follows:

a) contacting said surfaces with an aqueous solution having a pH ranging from about 2.0 to about 8.5, and containing at least 100 ppm of an hydrolyzable tanning extract, and then b) contacting said surfaces with an aqueous solution having a pH from about 2.0–8.5, and containing at least 25 ppm of a reducing agent, and then c) contacting said surfaces with an aqueous solution having a pH ranging from about 2.0–8.5 and containing at least 100 ppm of a chelating agent, wherein each contacting step is for a sufficient time and a sufficient temperature to, when sequentially formed, remove deposited iron oxides from the heat transfer surfaces.

The hydrolyzable tanning extracts which are useful in the practice of this invention include those tanning extracts chosen from the group consisting of sumach, volonea, chestnut tannins, and mixtures thereof. Of the above, chestnut tannins are primarily chosen because of their ready availability.

The reducing agents which are useful are primarily those reducing agents which are capable of reducing water soluble ferric ion to water soluble ferrous ion. These reducing agents may be chosen from the group consisting of water soluble acids or water soluble salts, preferably metal salts of formaldehyde sulfoxylate, sulfurous acid, water soluble dithionite salts, water soluble hydroxymethane sulfinic acid salts, and any water soluble mixtures of these acids or salts. Also available are the acid reaction product or neutralized salt thereof of the reaction product between sodium bisulfite and formaldehyde. This reaction product has sufficient reducing power to reduce ferric ion to ferrous ion in aqueous solution.

Alternatively, the iron oxide deposits which have been accumulated on heat transfer surfaces may be treated with an effective amount of a combination of the hydrolyzable tanning extract and the reducing agents of this invention. An effective amount of tanning extract is at least 100 ppm, and may be as much as 1000 ppm or higher. An effective amount of reducing agent is at least 25 ppm, and may be as high as 500 ppm, or higher. This combination of tanning extracts is normally made so that a weight ratio of from about 20:1 to about I:20 is present in the aqueous media in contract with the iron oxide deposits. Preferably, these ratios are from about 10:1 to about 1:10, and most preferably between about 5:1 to 1:5. These concentrations are effective in both sequentially added solutions and in a single combination formulation.

The ferrous ion chelating agents are chosen from the group consisting of citric acid, EDTA, HEDTA, and mixtures thereof. Preferably, the ferrous ion chelating agent is citric acid. Also preferably, the reducing agent is a metal salt of formaldehyde sulfoxylate, a metal salt of sulfurous acid, a metal salt of dithionite, a metal salt of hydroxymethane sulfonic acid, and a neutralized salt of a reaction product between formaldehyde and bisulfite ion. In the above, the metal salts are preferably those salts chosen from Na, K, Zn, and the like. The preferred metallic species are sodium salts and zinc salts.

The reducing agents are preferably those reducing agents which are capable of reducing ferric ion to ferrous ion in aqueous solution. Preferably these reducing agents also are capable of reducing ferric ion to ferrous ion when the iron is complexed either by tannins or other complexing agents such as citric acid.

However, the reducing agents, when used in this invention are not necessarily functioning only because of their capability to reduce ferric ions to ferrous ions in aqueous solution. Those reducing agents that have this capacity have been found to function in this invention.

The reducing agents are chosen from the group consisting of formaldehyde sulfoxylates, sulfurous acid or its salts, metal dithionite salts, salts of hydroxymethane sulfinic acid, salts of the reaction product between formaldehyde and bisulfite, and any water soluble mixtures of the above. The ferrous ion chelating agents are preferably those chosen from the group consisting of citric acid, EDTA, HEDTA, and mixtures thereof. Most preferably, citric acid is useful in this invention.

The effective concentration of chelating agents is normally at least 100 ppm, but concentrations of 500–1000 ppm are preferred, and concentrations above 1000 ppm can be used.

When practicing the invention, the iron oxide deposits are preferably removed by sequentially treating the heat transfer surfaces containing these iron oxide deposits with aqueous solutions of first the hydrolyzable tanning extracts, followed secondly by the reducing agents, and finally followed lastly with the ferrous ion chelating agents. However, the practice of the invention also incorporates the simultaneous use in solution of the hydrolyzable tanning extracts with the reducing agents of this invention followed by a second step which would include the use of ferrous ion chelating agents in the solution.

When the solution being used to treat the surfaces containing iron oxide deposits are those solutions normally present in the recirculating cooling tower waters, these solutions are obtained by adding each of the ingredients above in the sequence also taught above to the recirculating cooling waters. This is most easily accomplished by adding either concentrated aqueous solutions or solid components to the cooling water basin, dissolving the ingredients therein and recirculating them through the system by which recirculation the heat transfer surfaces containing iron oxide deposits are thereby contacted.

Preferably, the aqueous solutions in contact with the iron oxide deposits contains at least 100 ppm of hydrolyzable tanning extracts, most preferably chestnut tannins; at least 25 ppm of the reducing agent, preferably water soluble salts of formaldehyde sulfoxylate, carbohydrazide, and water soluble salts of hydroxymethane sulfinic acid, or the water soluble reaction products of formaldehyde and bisulfite salts. Finally, the chelating agents are contained in the aqueous solution at at least 100 ppm of citric acid, EDTA, HEDTA, and/or mixtures thereof.

These solutions are preferably in contact with the iron oxide deposits on the metal surfaces which act as heat exchange surfaces from a period of about ten (10) minutes up to and including time periods to four (4) to seven (7) days. The time of contact is quite variable and depends upon the temperatures of contact, the size of the total system being treated, and other variables which are not absolutely understood at this time. If an entire cooling system is being treated, time periods of contact can be up to two (2) days and beyond, and as much as six (6) to seven (7) days, or perhaps longer.

OPTIONAL INGREDIENTS

In addition to the solutions which are used in the above treatments, which contain hydrolyzable tanning extracts, reducing agents, and chelating agents, these solutions, either singularly or in combination as taught above, can also contain various quantities of polymeric dispersants. These dispersants are normally water soluble polymeric oligomers having a molecular weight ranging between about 1,000 up to and including about 50,000, preferably a molecular weight ranging between about 2,000 –20,000 and most preferably a molecular weight ranging between about 2,500–15,000. These materials are chosen from the group consisting of homopolymers of (meth)acrylic acid, copolymers of (meth)acrylic acid, and at least one of the monomers chosen from the group (meth)acrylic acid, acrylamide, methacrylamide, hydroxypropyl acrylate, AMPS, maleic anhydride, t-butyl acrylamide, and N-linear alkyl sulfonates of (meth)acrylamide, or mixtures of these polymeric dispersants. The term (meth)acrylic acid or (meth)acrylamide is meant to indicate both acrylic acid monomer and methacrylic acid monomer or acrylamide monomer and methacrylamide monomer.

These polymeric dispersants are present in the aqueous solution at effective concentrations to act as dispersants for inorganic and/or organic materials which are not soluble in the aqueous solution. The inorganic materials can include the iron oxides, as well as hardness precipitates such as calcium hydroxide, calcium carbonate, magnesium oxides or hydroxides, manganese oxides or hydroxides, magnesium carbonate, calcium phosphate, magnesium phosphate, zinc hydroxide and/or oxides, carbonates, and the like. Organic insolubles can include resins, insoluble polymers, naturally occurring dispersible insolubles such as those materials obtained from decaying wood, and the like.

The most preferred polymeric dispersant is a dispersant manufactured by reacting acrylamide and acrylic acid together in a ratio ranging between about 4:1 to about 1:4, where said ratio is a mole ratio of reactant monomers. These materials then may be reacted with various amine sulfonates to obtain sulfonated copolymers or terpolymers which contain pendant amide functional groups, pendant carboxylic acid functional groups, and pendant sulfonate functional groups. However, other dispersants also may be used, which dispersants may include, for example, copolymers of acrylic acid and hydroxypropyl acrylate, copolymers or terpolymers with acrylic acid and the monomer AMPS (AMPS stands for acrylamido methyl propyl sulfonate) where such copolymers or terpolymers also include acrylic acid and/or acrylamide, and polymaleate polymers such polymers being made by polymerization of polymaleic anhydride either by itself or with other vinylic monomers such as acrylic acid and other vinylic monomers such as those listed above. These dispersants may also include copolymers of acrylic acid and tertiary butyl acrylamide or terpolymers of (meth)acrylic acid and tertiary butyl acrylamide, or such other copolymers or terpolymers as disperse iron oxides, hardness precipitates, and organic insoluble matter in these waters. These various dispersants may be combined if needed.

In addition to the dispersing agents above, which dispersing agents may be added to each one of the solutions useful in treating iron oxide deposits or may be added to one or more of such solutions, other additives may also be included in these aqueous solutions. Of particular value are wetting agents or surfactants which are effective particulate wetting agents or surfactants having the ability to wet particulates which are dispersed in these aqueous solutions or particulates which become dispersed in these aqueous solutions. These wetting agents or surfactants are preferably chosen from the group consisting of nonionic surfactants, anionic surfactants, and mixtures thereof. Of particular note are those nonionic surfactants which are made from ethylene oxide, propylene oxide, nonyl phenols or other alkyl substituted phenols which are reacted with ethylene oxide or propylene oxide, and particularly include nonionic surfactants which are exemplified by commercial products such as Pluronic L-61, which is a low HLB ethylene oxide/propylene oxide block copolymer and Igepal CO-630 which is a high HLB alkylarylethoxylate containing ten moles of ethylene oxide on an alkyl aromatic backbone. It is especially valuable to blend various surfactants to accomplish the wetting capabilities required in the use of this invention.

These surfactant blends can also include anionic surfactants such as fatty acid salts or fatty acid sulfonate salts and the like. These surfactants are particularly exemplified by the commercial surfactants LAS (linear alkylate sulfonates) which is chemically described as a detergent surfactant.

It is particularly valuable in the use of this invention to remove iron oxide deposits from heat transfer surfaces by sequentially treating these surfaces with 1) an aqueous solution having a pH ranging from 2.0–8.5, preferably 4.0–8.5, which aqueous solution contains at least 100 ppm of an hydrolyzable tanning extract, preferably chestnut tannin, followed thereafter by treatment with an aqueous solution having a pH ranging from 2 0–8.5, preferably 4.0–8.5, which solution contains at least 25 ppm of a reducing agent having sufficient reducing power to convert water soluble ferric ion to water soluble ferrous ion, which reducing agents are preferably chosen from the group consisting of carbohydrazide, formaldehyde sulfoxylate and its salts, dithionites and their salts, hydroxymethane sulfinic acid and its salts, and the reaction product between formaldehyde and bisulfite ion and its salts, or mixtures thereof It is most preferable to use as a reducing agent Na or Zn salts of formaldehyde sulfoxylate, Na and Zn salts of hydroxymethane sulfinic acid, Na and Zn salts of the reaction product of formaldehyde and bisulfite ion, and mixtures thereof. The reason for this preferability of reducing agent is that in the presence of the above reducing agent, corrosion control of the base metal surfaces are controlled at reasonable values while the iron oxide deposits are removed. In the presence, for example, of simple sodium bisulfite, the metal surfaces on which the iron oxide deposits are attached, can be attacked and corroded beyond the point desired, if care is not exercised.

In the above systems, the hydrolyzable tanning extracts and preferred reducing agents can be admixed and used as a single treatment.

Following the treatments with the above tanning extracts and reducing agents the surfaces are then treated with a chelating agent, preferably citric acid or its salts, but which chelating agents may also include EDTA, HEDTA, citric acid and mixtures thereof.

The method of reducing iron oxide deposits from heat transfer surfaces also includes those methods wherein circulating industrial waters retained in a cooling tower basin are circulated within the cooling system containing said heat transfer surfaces and are contacted by these circulating industrial waters which waters are sequentially treated with an hydrolyzable tanning extract, a reducing agent having sufficient reducing power to convert ferric ion to ferrous ion, and a ferrous ion chelating agent.

When I refer to the use of a ferrous ion chelating agent, I mean simply that the chelating agent useful in this invention is capable of chelating ferrous ions in aqueous solution This does not necessarily imply that the chelating agent useful in this invention is, when used, only chelating ferrous ions.

The temperatures which are preferred to be used in all of the systems above described are those temperatures ranging between about 50° F. up to and including those temperatures of about 210° F. It is preferable that the temperatures are below boiling temperatures of the waters being used to contact the iron oxide deposits contained on the heat transfer surfaces. Preferably the water temperature ranges between about 60° F. to about 190° F. and most preferably these temperatures range between about 70° F. to about 160° F.

EXAMPLES

To exemplify this invention, the following examples are given. Each of these examples used a similar or identical experimental procedure which was as follows:

(a) A five gallon plastic pail to which a circulation unit is mounted (circulation unit used here was an MGW LAUDA Model T-1 circulating unit) on to either the plastic side of the pail or held in position by a clamping stand adjacent to the pail. The purpose of the circulator is to provide uniform mixing and stirring by means of a built-in pump and to provide temperature control through the built-in testing unit and temperature controller attached to these devices.

(b) The temperature for the tests were held between 100°–104° F. for all of the experiments cited below.

(c) Flow was modified when desired by the use of an in-line pump which was capable of increasing flow rates over the test specimens.

(d) The test specimens were suspended in the flowing aqueous media. These specimens had previously been created to contain iron oxide deposits, as explained later.

(e) In addition, other metal coupons for the purpose of measuring corrosion were either mounted in coupon racks, or held directly into the pail by use of plastic coated wire. The coupons were either admiralty brass (ADM) or 1010 mild steel and were standard, in-house issue coupons measuring approximately one-fourth inch by three inches and of nominal thickness (approximately one-sixteenth inch). Iron oxide removal experiments were done simultaneously with corroded ring specimens while corrosion studies were done using the metal coupons above.

The test specimens above were made from heavily corroded two and one-half inch internal diameter steel tubes obtained from various industrial plant sites. These tubes were assayed by metallurgical examination and the weight of the corrosion deposits determined. Our test specimens were obtained by sectioning the tubes into three-quarter inch width rings using an electric saw. Two of these three-quarter inch corroded and metal oxide deposited rings were mounted on a stainless steel rod, separated by use of a one-half inch width of stainless steel nut, and hung in the water circulating within the five gallon pail such that the top of the rings were approximately in the middle of the solution contained in the pail, and the rings were always in contact with the aqueous solution contained in the pail. In order to enhance and randomize any inherent deposit characteristic, these three-quarter inch cut rings were randomly mixed and numbered with a plastic tag and put into the five testing pails randomly and used in each set of the experiments. The chemical test environment consisted of two steps which were as follows:

Step 1, described as the tannation or conditioning step, consists of exposing the test specimens for a period of 3–5 days to the test solutions in the five pails which solutions consisted of the following.

Pail 1: 5,000 ppm chestnut tannin, 80 ppm on an active basis of a nonionic surfactant wetting agent, and 1,000 ppm of the chosen experimental accelerator/reducing agent. The reducing agents are given in the following tables. In these tests the nonionic surfactant is an equal-weight mixture of Pluronic L-61 and Igepal CO-630, although any nonionic surfactant which is soluble in water would function as would any admixture of nonionic and anionic surfactants as taught above. The pH of the system was the natural pH of the chestnut tannin solution which typically started out at pH of 6–7, and drifted with time and the addition of the reducing agent, to a pH as low as 3.5. A control was used, absent any reducing agent, which pH maintained throughout the test period of 3–5 days at a pH of approximately 5.5. Any water lost by evaporation was made up daily by the addition of water from the same source therefore maintaining the volume of the system constant.

Step 2, described as a chelation or iron oxide removal step, consisted of adding to the described solutions following the 3–5 day test period the following materials:

Approximately 20,000 ppm citric acid, and 1,000 ppm of a polymeric iron dispersant, which in these tests were a 2:1 weight ratio blend of a terpolymer of acrylic acid, acrylamide, and N-sulfomethylated acrylamide (approximate mole ratio, 2:1:1) and a copolymer of acrylamide and acrylic acid at a mole ration of 3:1. In addition, the reducing agent was maintained at a constant level about one-third to one-half of the to that of the level originally added by the addition of any required reducing agent to maintain this original concentration. The reducing agent can be added either in a separate Step 2, followed by a Step 3, a chelation or iron oxide removal step; or the reducing agent can be combined with the chestnut tannin in the first step above.

By the addition of these materials and the addition of the reducing agents, pHs ranging from 2–3 were obtained. A typical pH was 2.0–2.1. This iron oxide removal step was tested for periods ranging between about 1–2 days, giving a total experimental time ranging between about 4–7 days. Again, water which was lost by evaporation was added as required daily. Depending on the nature of the experiment, the nature of the experimental reducing agent, additions for maintenance of original concentrations of the reducing agent were required at 1 –2 times daily to achieve a maintenance level ranging between 200–400 ppm of the reducing agent.

To prevent microbiological growth, a biocide based on isothiazoline formulations was also added, but this is not necessary except in the situation where waters can support microbiological growth. Other microbiological agents could also be used. In the experiments, these materials were added so as to not encourage any erratic results due to microbiological growth. Although pHs of 2.0–2.1 were typically observed during the experimental period, it is more typical in actual practice that pHs ranging between about 2.5 to 8.5 would be observed, and it is preferable to operate these inventions at a pH ranging between about 5.0 to about 8.5. During the course of these experiments, pH, soluble and total iron, concentrations of tannin and residual reducing agents concentration were monitored. In all of the experiments, several hundred parts per million total iron and soluble iron were observed approximately 24–36 hours into the test and about 400 ppm total iron was observed as a typical value.

Corrosion rates expressed in the tables below as mils per year lost (mpy) were obtained using standard methods of weight loss and surface area measurements using a standardized coupon preparation procedure.

Improvement in iron oxide removal was based on visual observation along with the amount of bare mild steel surface showing on the test rings. These rings were always visually evaluated after rinsing with cold tap water and drying for about one hour at 105° C. The results of the above tests are presented in Table I. Table I always has the same concentration of hydrolyzable tanning extract and the same concentrations of nonionic surfactant, iron dispersant, and citric acid. The type and concentration of reducing agent are changed as noted in the Table, and both corrosion rates as well as iron oxide deposit removal ratings are indicated.

TABLE I

Evaluation of Cleaning (Rust Removal) and Corrosion Tendencies of Additives to On Line Cleaning Process[1] (5,000 ppm Tannin; 1,000 ppm Initial Slug Reducing Agent Additive; Initial pH ~6.5 at 100° F.)

| Additive | Coupon Corrosion (mpy) MS | ADM | Deposit Removal Ranking[2] | Notes |
|---|---|---|---|---|
| Control (no additive)[3] | 148 | 11.7 | 5 | No additive; Standard process |
| $HOCH_2SO_2Na$ | 16.2/17.3 | 2.3 | 8.5–9.0 | $HOCH_2SO_2Na$ - Sodium formaldehyde sulfoxylate |
| $HOCH_2SO_2Na$ | 39.6 | | 8.0–8.5 | Same as above |
| Formaldehyde | 46.5 | | 5 | $H_2CO$ |
| Carbohydrazide | 51.2 | | 5 | $NH_2NHCONHNH_2$ |

TABLE I-continued

Evaluation of Cleaning (Rust Removal) and Corrosion Tendencies of Additives to On Line Cleaning Process[1] (5,000 ppm Tannin; 1,000 ppm Initial Slug Reducing Agent Additive; Initial pH ~6.5 at 100° F.)

| Additive | Coupon Corrosion (mpy) MS | ADM | Deposit Removal Ranking[2] | Notes |
|---|---|---|---|---|
| $NaHSO_3$ Plus corrosion Rodine 31A | 59.2 | | 4 | Rodine 31A commercial inhibitor for mild steel |
| Formaldehyde - Bisulfite Adduct | 73.7 | | 6–7 | $HOCH_2SO_3Na$ |
| Hypophosphite | 121.8 | | 5 | $NaH_2PO_2$ |
| Hydroxylamine-Hydrochloride | 230 | | 5 | $NH_2OH.HCl$ |
| $NaHSO_3$ | 195.3 | | 8.0–8.5 | Sodium bisulfite |
| $NaHSO_3$ | 225 | 11.6 | — | Sodium bisulfite |
| $NaHSO_3$ | 234.6 | 25.1 | 8–9 | Sodium bisulfite |

[1]Process includes a Tannation Step (surface conditioner) for 4 days and a 2 day chelation step with 20,000 ppm citric acid at pH 2–3 plus dispersant. A surfactant is also slugged in during Tannation.
[2]In the scale, ten (10) is best.
[3]Chestnut tannin and citric acid used at concentration equal to all listed tests control - no reducing agent.

As can be observed, the invention as described above is most effective when the reducing agents are those reducing agents which are chosen from the group consisting of sodium formaldehyde sulfoxylate, a formaldehyde bisulfite anion adduct as the sodium salt, and sodium bisulfite. However, it is also to be noted that sodium bisulfite has a much higher corrosion value than would be desired, so therefore, the most preferred use of the reducing agent would be in the presence of sodium formaldehyde sulfoxylate and/or the reaction product of formaldehyde and sodium bisulfite. However, it is also to be noted that, carbohydrazide is an effective reducing agent for the use in this invention.

Having described my invention, I claim:

1. An improved method for removing iron oxide deposits from heat transfer surfaces which comprises sequentially (a) contacting said surfaces with an aqueous solution having a pH from about 2.0 to about 8.5 and containing at least 100 ppm of a hydrolyzable tanning extract, and then (b) contacting said surfaces with an aqueous solution having a pH from about 2.0–8.5 and containing at least 25 ppm of a reducing agent, and then (c) contacting said surfaces with an aqueous solution having a pH from about 2.0–8.5 and containing at least 100 ppm of a ferrous ion chelating agent, wherein each contacting step is for a sufficient time and a sufficient temperature to, when sequentially performed, to remove iron oxide deposits from heat transfer surfaces.

2. The method of claim 1 wherein one or more of each aqueous solution may coeffective particulate wetting amount of a surfactant chosen from the group consisting of nonionic surfactants, anionic surfactants, and mixtures thereof.

3. The method of claim 1 or claim 2 wherein the hydrolyzable tanning extract is chosen from the group consisting of sumach, volonea, chestnut tannin, and mixtures thereof; the reducing agent is chosen from the group consisting of water soluble metal salts of formaldehyde sulfoxylate, water soluble metal salts of sulfurous acid, water soluble metal dithionite salts, water soluble metal salts of hydroxymethane sulfinic acid, carbohydrazide, and water soluble mixtures thereof; and the ferrous ion chelating agents are chosen from the group consisting of citric acid, EDTA, HEDTA, and mixtures thereof.

4. The method of claim 3 wherein the aqueous solution in any of the contacting steps contains a polymeric dispersant.

5. The method of claim 4 wherein the polymeric dispersant is chosen from the group consisting of homopolymers of (meth)acrylic acid, copolymers of (meth)acrylic acid and at least one of the monomers chosen from the group (meth)acrylic acid, acrylamide, methacrylamide, hydroxypropyl acrylate, AMPS, maleic anhydride, t-butyl acrylamide, and N-linear alkyl sulfonates of (meth)acrylamide, and mixtures thereof.

6. An improved method for removing iron oxide deposits from heat transfer surfaces which comprises sequentially treating said surfaces with (1) an aqueous solution having a pH ranging from 2.0–8.5 and containing at least 100 ppm of a hydrolyzable tanning extract; (2) an aqueous solution having a pH ranging from 2.0–8.5 and containing at least 25 ppm of a reducing agent having sufficient reducing power to convert water soluble ferric ion to water soluble ferrous ion; and (3) an aqueous solution containing at least 100 ppm of a ferrous ion chelating agent; and wherein each aqueous solution of (1), (2), and (3) above is in contact with the heat transfer surface for a time sufficient and at a temperature sufficient to remove iron oxide deposits therefrom.

7. The method of claim 6 wherein one or more of each aqueous solution may contain an effective particulate wetting amount of a surfactant chosen from the group consisting of nonionic surfactants, anionic surfactants, and mixtures thereof.

8. The method of claim 6 or claim 7 wherein the hydrolyzable tanning extract is chosen from the group consisting of sumach, volonea, chestnut tannin, and mixtures thereof; the reducing agent is chosen from the group consisting of water soluble metal salts of formaldehyde sulfoxylate, water soluble metal salts of sulfurous acid, water soluble metal dithionite salts, water soluble metal salts of hydroxymethane sulfinic acid, carbohydrazide, and water soluble mixtures thereof; and the ferrous ion chelating agents are chosen from the group consisting of citric acid, EDTA, HEDTA, and mixtures thereof.

9. The method of claim 8 wherein the aqueous solution in any of the contacting steps contains a polymeric dispersant.

10. The method of claim 9 wherein the polymeric dispersant is chosen from the group consisting of homopolymers of (meth)acrylic acid, copolymers of (meth)acrylic acid and at least one of the monomers chosen from the group (meth)acrylic acid, acrylamide, methacrylamide, hydroxypropyl acrylate, AMPS, maleic anhydride, t-butyl acrylamide, and N-linear alkyl sulfonates of (meth)acrylamide, and mixtures thereof.

11. A method of removing iron oxide containing deposits from heat transfer surfaces in contact with circulating industrial waters retained in a cooling tower basin which comprises sequentially treating the cooling tower basin waters with (1) an hydrolyzable tanning extract, (2) a reducing agent having a sufficient reducing power to convert ferric ion to ferrous ion, and a ferrous ion chelating agent, said industrial waters having a temperature ranging between about 60° F. to about 180° F.

12. The method of claim Il wherein the industrial waters are also treated with a surfactant chosen from the group consisting of nonionic and anionic surfactants and mixtures thereof.

13. The method of claim 11 or claim 12 wherein the hydrolyzable tanning extract is chosen from the group consisting of sumach, volonea, chestnut tannin, and mixtures thereof; the reducing agent is chosen from the group consisting of water soluble metal salts of formaldehyde sulfoxylate, water soluble metal salts of sulfurous acid, water soluble metal dithionite salts, water soluble metal salts of hydroxymethane sulfinic acid, carbohydrazide, and water soluble mixtures thereof; and the ferrous ion chelating agents are chosen from the group consisting of citric acid, EDTA, HEDTA, and mixtures thereof.

14. The method of claim 13 wherein the aqueous solution in any of the contacting steps contains a polymeric dispersant.

15. The method of claim 14 wherein the polymeric dispersant is chosen from the group consisting of homopolymers of (meth)acrylic acid, copolymers of (meth)acrylic acid and at least one of the monomers chosen from the group (meth)acrylic acid, acrylamide, methacrylamide, hydroxylpropyl acrylate, AMPS, maleic anhydride, t-butyl acrylamide, and N-linear alkyl sulfonates of (meth)acrylamide, and mixtures thereof.

16. A method of removing iron oxide containing deposits from heat transfer surfaces, which method comprises sequentially treating the iron oxide deposits on said heat transfer surfaces with the following treatment agents:

(a) an aqueous solution containing at least 100 ppm of an hydrolyzable tanning extract in combination with at least 25 ppm of a reducing agent having sufficient reducing power to convert ferric ion to ferrous ion in aqueous solution, followed thereafter by the treatment with an aqueous solution containing a ferrous ion chelating agent (b) said aqueous solutions contacting the iron oxide deposits on the heat transfer surfaces at temperatures ranging between about 60° F. to about 200° F.

17. The method of claim 16 wherein the aqueous solutions used to treat the iron oxide deposits also contain an effective surface wetting amount of a surfactant chosen from the group consisting of nonionic and anionic surfactants, and mixtures thereof.

18. The method of claim 16 or 17 wherein the hydrolyzable tanning extract is chosen from the group consisting of sumach, volonea, chestnut tannin, and mixtures thereof; the reducing agent is chosen from the group consisting of formaldehyde sulfoxylate, sulfurous acid, dithionite salts, hydroxymethane sulfinic acid, carbohydrazide, and the reaction products of formaldehyde and bisulfite salts, water soluble metal salts of each of the above, and mixtures thereof; and the ferrous ion chelating agents are chosen from the group consisting of citric acid, EDTA, HEDTA, and mixtures thereof; and further wherein the aqueous solutions also contain a polymeric dispersant chosen from the group consisting of homopolymers of (meth)acrylic acid, copolymers of (meth)acrylic acid, and at least one of the monomers chosen from the group consisting of (meth)acrylic acid, acrylamide, methacrylamide, hydroxypropyl acrylate, AMPS, maleic anhydride, t-butyl acrylamide, and N-linear alkyl sulfonates of (meth)acrylamide, and mixtures thereof.

* * * * *

UNITED STATES PATENT AND TRADEMARK OFFICE

CERTIFICATE OF CORRECTION

PATENT NO. : 5,037,483

DATED : August 6, 1991

INVENTOR(S) : LEONARD DUBIN

It is certified that error appears in the above-identified patent and that said Letters Patent is hereby corrected as shown below:

Column 9, Line 55, Claim 2 each aqueous solution may [coeffective] particulate wet-

LETTERS PATENT SHOULD READ AS:

aqueous solution may <u>contain an effective</u> particulate wet-

Signed and Sealed this

Eighth Day of December, 1992

*Attest:*

DOUGLAS B. COMER

*Attesting Officer*

*Acting Commissioner of Patents and Trademarks*